US005161271A

United States Patent [19]

Gronbach

[11] Patent Number: 5,161,271

[45] Date of Patent: Nov. 10, 1992

[54] WATERBED MATTRESS COVER WITH REMOVABLE TOP AND INSERTABLE FOAM PADS

[76] Inventor: Carter E. Gronbach, 15152 Touraine Way, Irvine, Calif. 92714

[21] Appl. No.: 711,907

[22] Filed: Jun. 7, 1991

[51] Int. Cl.[5] ..... A47C 27/08

[52] U.S. Cl. ..... 5/451; 5/422; 428/178; 428/316.6

[58] Field of Search ..... 5/451, 450, 449, 470, 5/486, 500, 502, 422, 452, 917; 428/316.6, 178

[56] References Cited

U.S. PATENT DOCUMENTS 4,187,566 2/1980 Peterson ..... 5/474
4,424,600 1/1984 Callaway ..... 5/455
4,549,323 10/1985 Brockhaus ..... 5/451
4,932,088 6/1990 Johenning et al. ..... 5/451
4,972,534 11/1990 Hutton ..... 5/451

*Primary Examiner*—Alexander Grosz

[57] ABSTRACT

A waterbed mattress cover has a peripheral side and a top releasably attached to the side. Both the cover and side are quilted. The top may be removed from the side so that it may be washed or cleaned. The underside of the top has an opening and there are one or more foam pads insertable through the opening. The foam pads are generally coextensive with the area of the top and include a plurality of layers of foam which differ both in density and in thickness. The foam layers are separated by an air barrier and a layer of reflective foil.

8 Claims, 1 Drawing Sheet

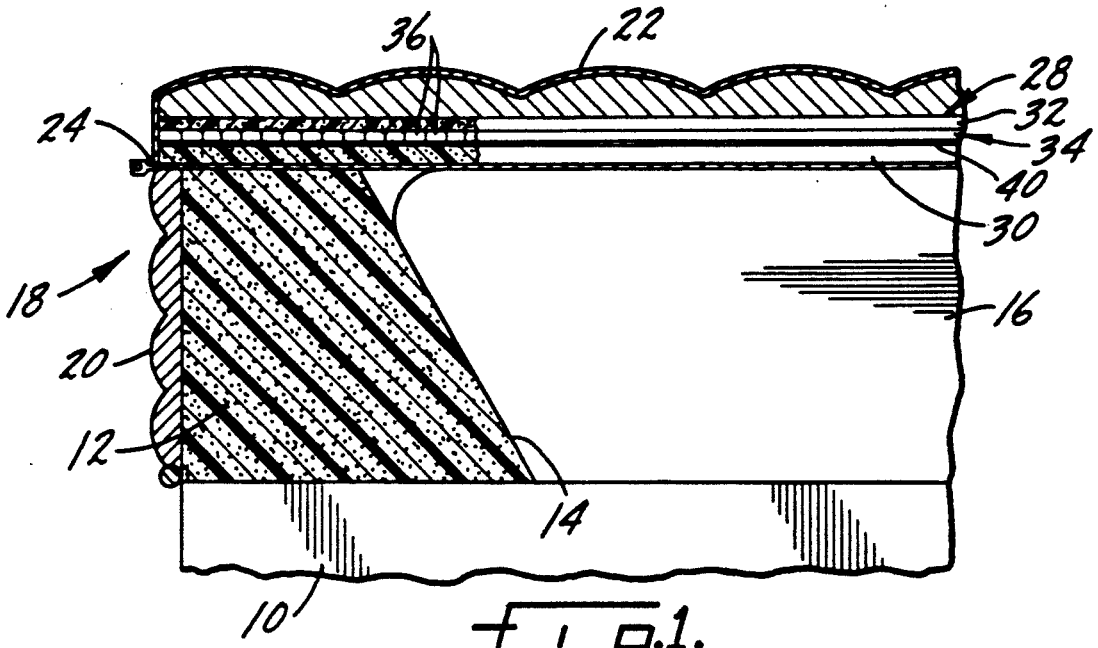
Fig. 1.
Fig. 2.
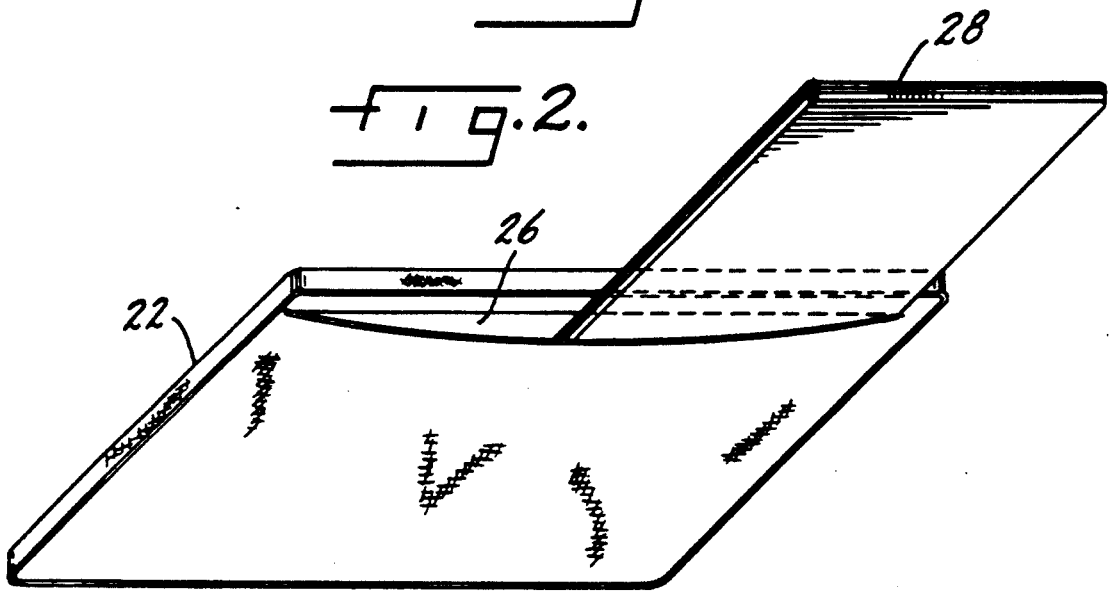
Fig. 3.
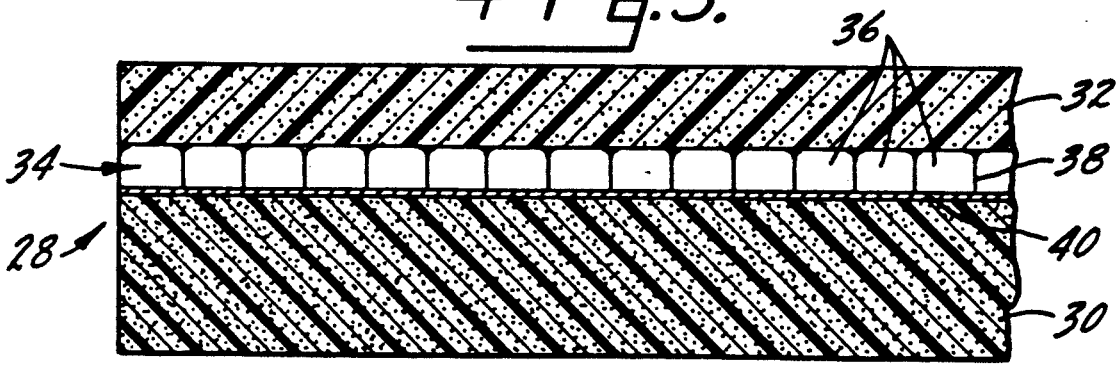

WATERBED MATTRESS COVER WITH REMOVABLE TOP AND INSERTABLE FOAM PADS

THE FIELD OF THE INVENTION

The present invention relates to waterbed mattresses and in particular to the mattress cover. It is conventional to have a quilted cover, particularly on softsided waterbed mattresses and normally the cover is at least in part removable. The present invention contemplates a zipper connection for the top of the quilted cover to the peripheral side so that the cover may be removed for washing or cleaning. There are foam pad inserts within the cover which provide both insulation and added comfort. The foam pad inserts, and there may be one or more, have foam layers of differing density and differing thickness, with the layers being separated by an insulating air barrier.

DESCRIPTION OF THE RELATED ART

There are many issued patents which describe quilted covers for softsided waterbed mattresses. Most of the art has the zipper attachment at the base of the peripheral side wall. There is art which shows the zipper attachment along the top of the quilted side wall. The present invention is specifically concerned with the quilted cover in which the top alone may be removed and in which the top may have one or more foam inserts for comfort and insulation for the mattress user.

SUMMARY OF THE INVENTION

The present invention relates to the quilted cover for a waterbed mattress and in particular to removable inserts for the removable top of the cover.

A primary purpose of the invention is to provide a quilted exterior cover for a softsided waterbed mattress which has a zip-off top which permits the top to be washed or cleaned and which has one or more removable foam pads positioned within a pocket in the top.

Another purpose is to provide pads for the use described made of a plurality of layers of polyurethane foam, with the layers differing in thickness and in density.

Another purpose is a foam pad insert for the use described in which the layers of differing density and thickness are separated by an air barrier and reflective foil.

Another purpose is a waterbed mattress cover as described in which the removable inserts are reversed depending upon the season of the year.

Other purposes will appear in the ensuing specification, drawings and claims.

BRIEF DESCRIPTION OF THE DRAWINGS

The invention is illustrated diagrammatically in the following drawings wherein:

FIG. 1 is a partial vertical section through a waterbed mattress as described herein, FIG. 2 is a perspective of the quilted mattress cover, illustrating one of the cover inserts, and FIG. 3 is an enlarged vertical section through the cover insert of FIG. 2.

DESCRIPTION OF THE PREFERRED EMBODIMENT

In the drawings, a water mattress of the softsided type is illustrated in FIG. 1 and includes a base or platform 10 upon which is supported a peripheral foam border 12. The border 12 along with the platform 10 define a central cavity 14 within which may be positioned the water mattress shell 16. The shell is customarily formed of vinyl and may include one or more of the known types of hydraulic and/or fiber baffles to reduce wave motion within the mattress.

Extending about the foam border 12 and over the top of the mattress shell 16 is a quilted cover 18. The cover 18 includes side walls 20 and a top 22. The top 22 is connected by a zipper 24 to the side walls 20. Thus, the top may be removed for washing or cleaning.

The quilted top 22 is shown in more detail in FIG. 2 and the inserts for the top are shown in FIG. 3. As illustrated in FIG. 2, top 22 may have a bottom opening 26 so that one or more foam pads 28 may be inserted within and be generally coextensive with the area or surface of top 22. There may be a single foam pad which covers the entire extent of the cover or there may be separate, generally equally sized foam pads. What is important is the construction of the pads and the fact that they are removable for cleaning or washing of the cover.

Each of the foam pads may include a construction as illustrated in FIG. 3. There are a plurality of layers of polyurethane foam, a bottom layer 30 and a top layer 32. Layer 30 is substantially thicker than layer 32 and has a higher density. For example, the density of layer 30 may be 1.1 lbs/sq.ft., whereas the density of layer 32 may be 0.9 lbs/sq.ft.

The polyurethane layers of differing density and thickness may be separated by an air barrier indicated generally at 34 and which comprises a plurality of air compartments 36, each of which is encapsulated in plastic walls 38. This construction is commonly known as "bubble pack" and is used in packaging for protection of a shipped product. On one side of the air barrier 34 is a layer of metal reflecting foil 40. It is preferred to have the foil only on one side of the pad construction, however, in some applications it may be on both sides of the air barrier.

In use, the pad will have the orientation illustrated in FIG. 3 for the colder months of the year and will be reversed for the warmer months. Specifically, in winter you want the side of the pad with minimum foam thickness closest to the sleeper's body so that heat from the body may be reflected by the foil and so that the air barrier will separate and form an insulation between the sleeper's body and the underlying water container. In summer it is normal for the pad to be reversed, as you do not want as much reflected heat and therefore the thicker and denser layer of foam 30 will be closest to the sleeper's body.

When the quilted cover of the mattress construction becomes soiled, it may be removed by the zipper 24, the pads 28 taken out of the pocket inside of the cover and then the cover cleaned. The pads may be inserted in any desired orientation depending upon the season and the particular preference of the sleeper who uses that portion of the mattress.

Whereas the preferred form of the invention has been shown and described herein, it should be realized that there may be many modifications, substitutions and alterations thereto.

The embodiments of the invention in which an exclusive property or privilege is claimed are defined as follows:

1. A cover for a waterbed mattress including a peripheral side and a top releasably attached to the peripheral side, said top having an underside with an opening therein, and at least one foam pad insertable through said opening, said at least one foam pad being generally coextensive with the area of said top, said at least one foam pad having a plurality of layers of foam separated by an air barrier including a plurality of air compartments separated by walls, and a layer of reflective foil along one side of said air barrier.

2. The mattress cover of claim 1 further characterized by a plurality of pads insertable through said opening to a position within said releasable top, said pads in combination being generally coextensive with said top.

3. The mattress cover of claim 1 further characterized in that there are a pair of pads insertable through said opening to a position within said releasable top, said pads being generally equal in area.

4. The mattress cover of claim 1 further characterized in that said at least one foam pad is formed of two layers of foam differing in density and in thickness.

5. The mattress cover of claim 4 further characterized in that said layer of reflective foil is between said air barrier and the thicker foam layer.

6. The mattress cover of claim 1 further characterized in that said cover is exteriorly quilted.

7. A waterbed mattress including a base, a border mounted on said base and defining a chamber, an enclosed container of water positioned in said chamber and laterally supported by said border, and a cover enclosing said border and water container, said cover including a peripheral side and a top releasably attached to the peripheral side, said top having an underside with an opening therein, and at least one foam pad insertable through said opening, said at least one foam pad being generally coextensive with said top, said at least one foam pad having a plurality of layers of foam separated by an air barrier including a plurality of air compartments separated by walls, and a layer of reflective foil along one side of said air barrier.

8. The waterbed mattress of claim 7 further characterized in that said at least one foam pad includes a pair of pads, each having a plurality of foam layers differing in thickness and in density.

* * * * *